US007196606B2

(12) United States Patent
Sawazaki et al.

(10) Patent No.: US 7,196,606 B2
(45) Date of Patent: Mar. 27, 2007

(54) IGNITION COIL APPARATUS FOR AN INTERNAL COMBUSTION ENGINE

(75) Inventors: Nobuyuki Sawazaki, Tokyo (JP); Tomokazu Umezaki, Tokyo (JP)

(73) Assignee: Mitsubishi Denki Kabushiki Kiasha, Tokyo (JP)

( * ) Notice: Subject to any disclaimer, the term of this patent is extended or adjusted under 35 U.S.C. 154(b) by 0 days.

(21) Appl. No.: 11/222,940

(22) Filed: Sep. 12, 2005

(65) Prior Publication Data

US 2006/0255898 A1 Nov. 16, 2006

(30) Foreign Application Priority Data

May 12, 2005 (JP) ..... 2005-139503

(51) Int. Cl.
*H01F 27/02* (2006.01)

(52) U.S. Cl. ..... 336/92; 336/96; 336/90

(58) Field of Classification Search ..... 336/90, 336/92, 96

See application file for complete search history.

(56) References Cited

U.S. PATENT DOCUMENTS 4,130,331 A * 12/1978 Neff et al. ..... 439/396
5,692,482 A * 12/1997 Shimizu et al. ..... 123/634
5,949,320 A * 9/1999 Cossins et al. ..... 336/223
6,030,260 A * 2/2000 Kikuchi et al. ..... 439/890
6,611,077 B2 * 8/2003 Yokomizo et al. ..... 310/221

FOREIGN PATENT DOCUMENTS

JP 2000-348785 A 12/2000

* cited by examiner

*Primary Examiner*—Anh Mai
(74) *Attorney, Agent, or Firm*—Sughrue Mion, PLLC

(57) ABSTRACT

An ignition coil apparatus for an internal combustion engine can suppress an increase in the manufacturing cost of a terminal of a low-tension side connector resulting from variation in a wire diameter of an one end of a primary winding, and can ensure a stable fusing state. The positive terminal side fusing portion is composed of a planar portion and a turned portion that is inversely turned back from the planar portion to cooperate therewith to clamp a winding start conductor portion. A first bent portion of a radius of curvature R is formed at a base end portion of the turned portion. A second bent portion with its tip end tilted toward a planar portion is formed at an intermediate portion of the turned portion.

5 Claims, 7 Drawing Sheets

IGNITION COIL APPARATUS FOR AN INTERNAL COMBUSTION ENGINE

BACKGROUND OF THE INVENTION

1. Field of the Invention

The present invention relates to an ignition coil apparatus for an internal combustion engine that is provided with a low-tension side connector whose terminal is electrically connected to an end of a primary winding through fusing.

2. Description of the Related Art

As an ignition coil apparatus for an internal combustion engine, there has been known one in which a primary winding is electrically connected at its one end to a terminal of a low-tension side connector through a fusing method.

In the case of this ignition coil apparatus for an internal combustion engine, as shown in a first patent document (Japanese patent application laid-open No. 2000-348785) for example, the terminal of the low-tension side connector connected to the one end of the primary winding has a fusing portion turned or bent into a U shape that is formed of a planar portion and a turned portion with its base end portion having a radius of curvature R.

An electric connection between the terminal of the low-tension side connector and the one end of the primary winding is carried out as follows. That is, the fusing portion with the one end of the primary winding being clamped between the planar portion and the turned portion is placed on a first fusing electrode, and a second fusing electrode arranged in opposition to the first fusing electrode is pushed to the first fusing electrode through the fusing portion, whereby an enamel film on the one end of the primary winding is burnt out by supplying an electric current to the first and second fusing electrodes.

In the ignition coil apparatus for an internal combustion engine as constructed above, the planar portion of the fusing portion and a main portion of the turned portion except the base end portion are parallel with respect to each other and are of planar shapes, thus posing the following problems.

(1) Since the radius of curvature R of the base end portion is set according to the cross-sectional shape of the one end of the primary winding, the terminal is required to have a radius of curvature of R matched to a wire diameter (i.e., the diameter of a winding wire or conductor) at the one end of the primary winding, and hence, a special press die is needed for that purpose and the manufacturing cost increases accordingly.

(2) Since the fusing portion is opened at a side opposite to the base end portion, there is a fear that the one end of the primary winding might be moved toward the side opposite to the base end portion when the secondary electrode is pushed to the primary electrode before fusing, so a current path formed at the time of fusing might vary in each fusing, thus making it impossible to obtain a stable fusing state.

SUMMARY OF THE INVENTION

Accordingly, the present invention is intended to obviate the above-mentioned problems, and has for its object to obtain an ignition coil apparatus for an internal combustion engine which is capable of suppressing an increase in the manufacturing cost of a terminal of a low-tension side connector resulting from variation in a wire diameter at one end portion of a primary winding, and of ensuring a stable fusing state.

Bearing the above object in mind, according to the present invention, there is provided an ignition coil apparatus for an internal combustion engine which includes: a case; a center core arranged in the case; a primary coil and a secondary coil arranged outside of the central core; and a low-tension side connector with a terminal having a fusing portion electrically connected through fusing with an end of a primary winding of the primary coil. The fusing portion includes a planar portion and a turned portion that is inversely bent back from the planar portion to cooperate therewith to clamp the end of the primary winding. A first bent portion of a radius of curvature R is formed at a base end portion of the turned portion, and a second bent portion with its tip end tilted to the planar portion is formed at an intermediate portion of the turned portion.

According to the ignition coil apparatus for an internal combustion engine of the present invention as constructed above, it is possible to suppress an increase in the manufacturing cost of the terminal of the low-tension side connector resulting from variation in the wire diameter of the one end of the primary winding, as well as to ensure a stable fusing state.

The above and other objects, features and advantages of the present invention will become more readily apparent to those skilled in the art from the following detailed description of a preferred embodiment of the present invention taken in conjunction with the accompanying drawings.

DESCRIPTION OF THE PREFERRED EMBODIMENT

Hereinafter, a preferred embodiment of the present invention will be described in detail while referring to the accompanying drawings.

Embodiment 1

Figure 1:
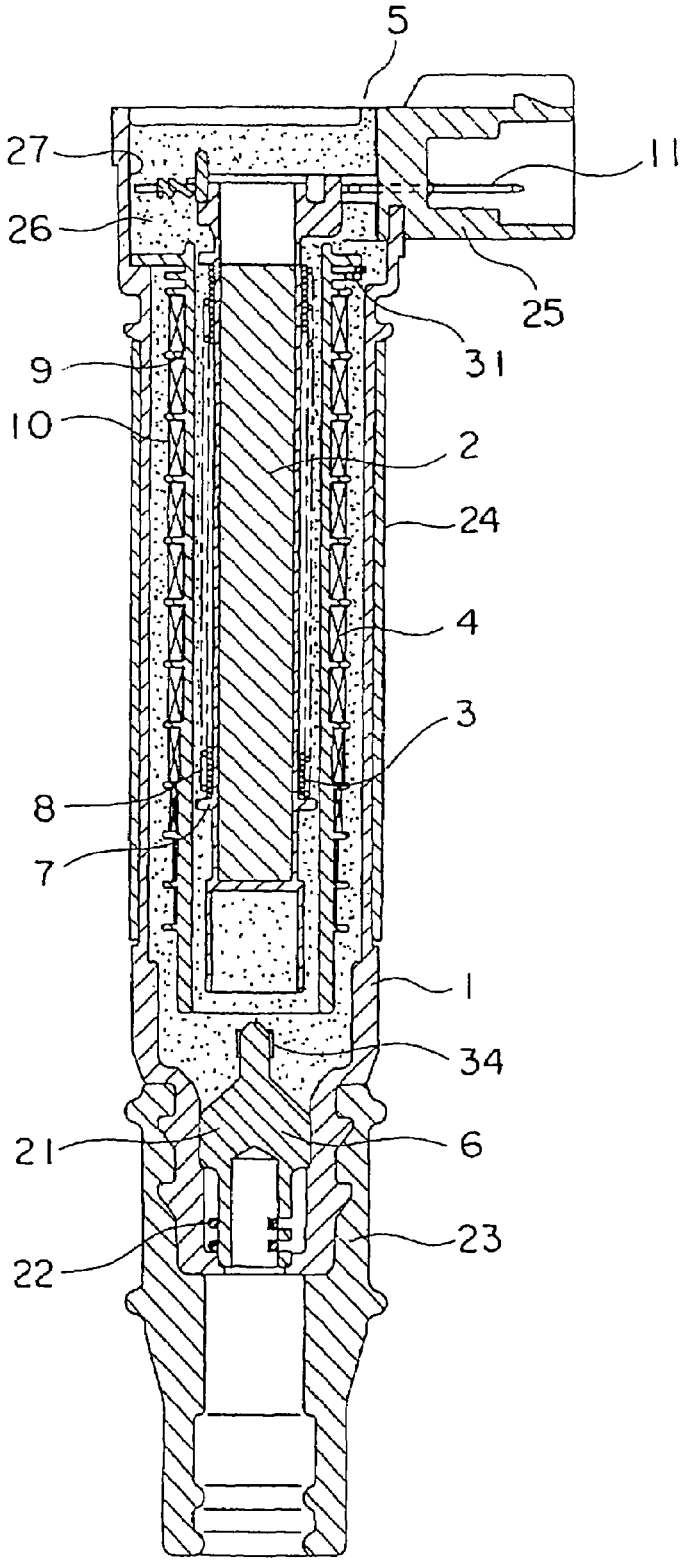
FIG. 1 is a cross sectional view showing an ignition apparatus for an internal combustion engine according to a first embodiment of the present invention.
Figure 2:
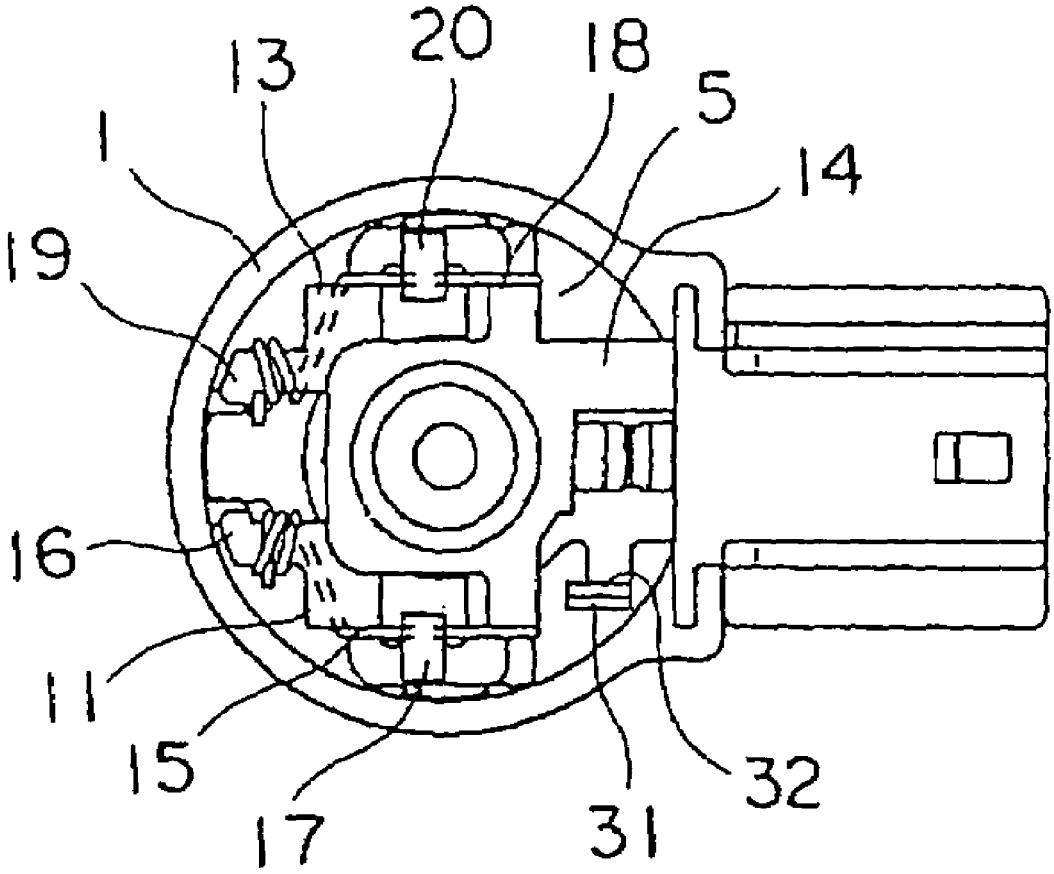
FIG. 2 is a plan view of FIG. 1 with an insulating material in a case being excluded.
Figure 3:
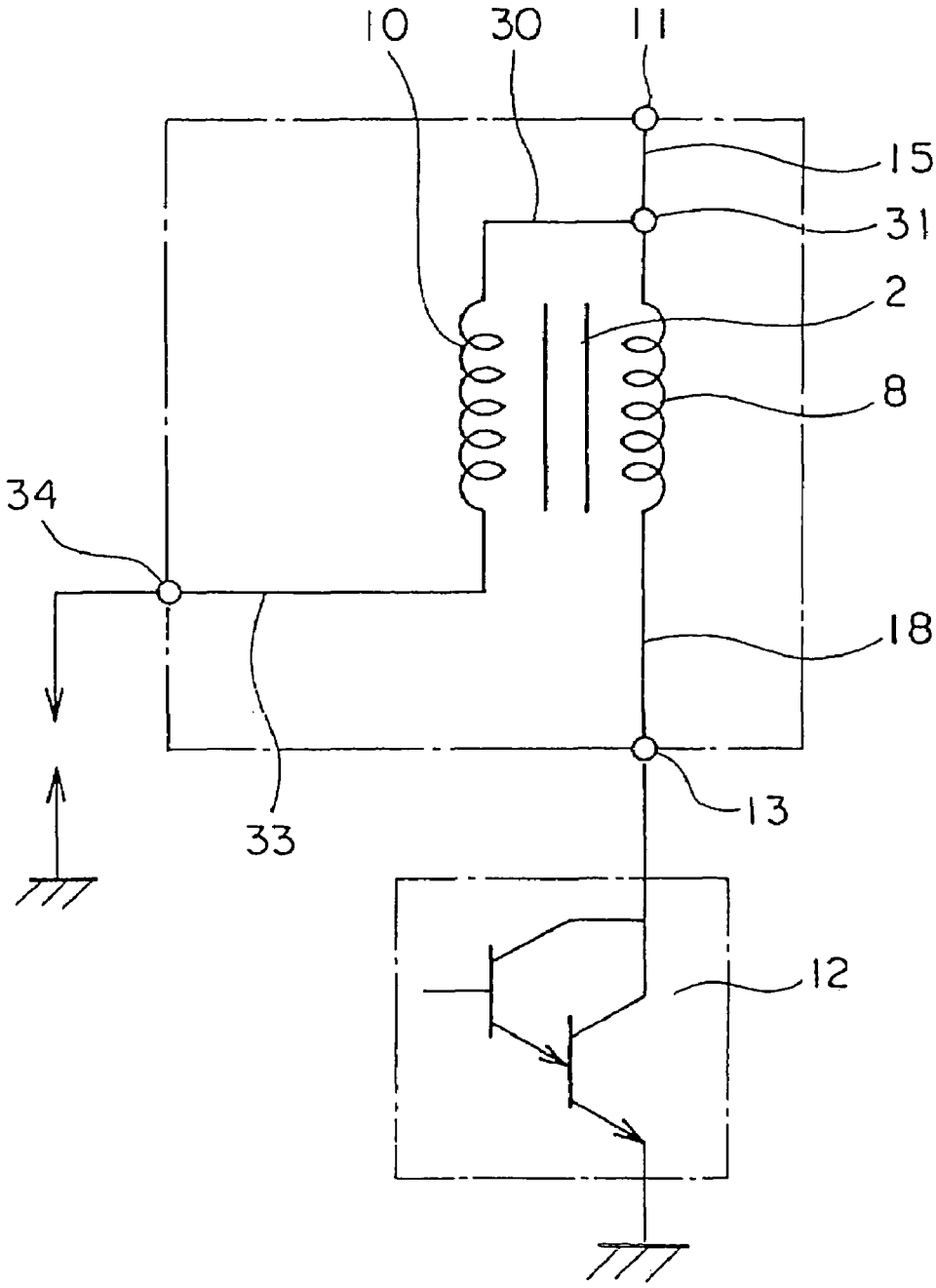
FIG. 3 is an electric circuit diagram of FIG. 1.

FIG. 1 is a plan view of an ignition coil apparatus for an internal combustion engine (hereinafter abbreviated as a coil apparatus) according to a first embodiment of the present invention. FIG. 2 is a plan view of the coil apparatus of FIG. 1 with an insulating material being excluded, and FIG. 3 is an electric circuit diagram of the coil apparatus FIG. 1.

In this coil apparatus, a column-shaped center core 2 is arranged in in a case 1 of a bottomed cylindrical shape, and the center core extends along and on the central axis of the case 1, and is formed of laminated or stacked strip-shaped silicon steel sheets. A primary coil 3 and a secondary coil 4 are arranged on the outer periphery of this center core 2 in a concentric relation. A low-tension side connector 5 electrically connected to the primary coil 3 is arranged at an upper portion of the case 1, and a high-tension side connector 6 electrically connected to a spark plug (not shown) is arranged at a lower portion of the case 1.

An elastic cap 23, being press-fitted into the inner wall surface of a plug hole (not shown) in the internal combustion engine, is arranged at an end of the case 1.

An outer layer core 24, which forms a closed magnetic circuit together with the center core 2, is arranged on the outer peripheral side wall of the case 1.

The center core 2, the primary coil 3, the secondary coil 4, the high-tension side connector 6, etc., are disposed in the case 1, and the low-tension side connector 5 is fitted into an opening portion 27 of the case 1, after which an insulating material 26 comprising an epoxy resin before thermally set is filled into the case 1, and it is thermally set at a high temperature.

The primary coil 3 has a primary bobbin 7 of a bottomed cylindrical shape, and a primary winding 8 that is formed of a conductor in the form of an enameled wire wound around the primary bobbin 7.

The secondary coil 4 has a secondary bobbin 9 of a cylindrical shape, and a secondary winding 10 that is formed of a conductor in the form of an enameled wire wound around the secondary bobbin 9.

Figure 4:
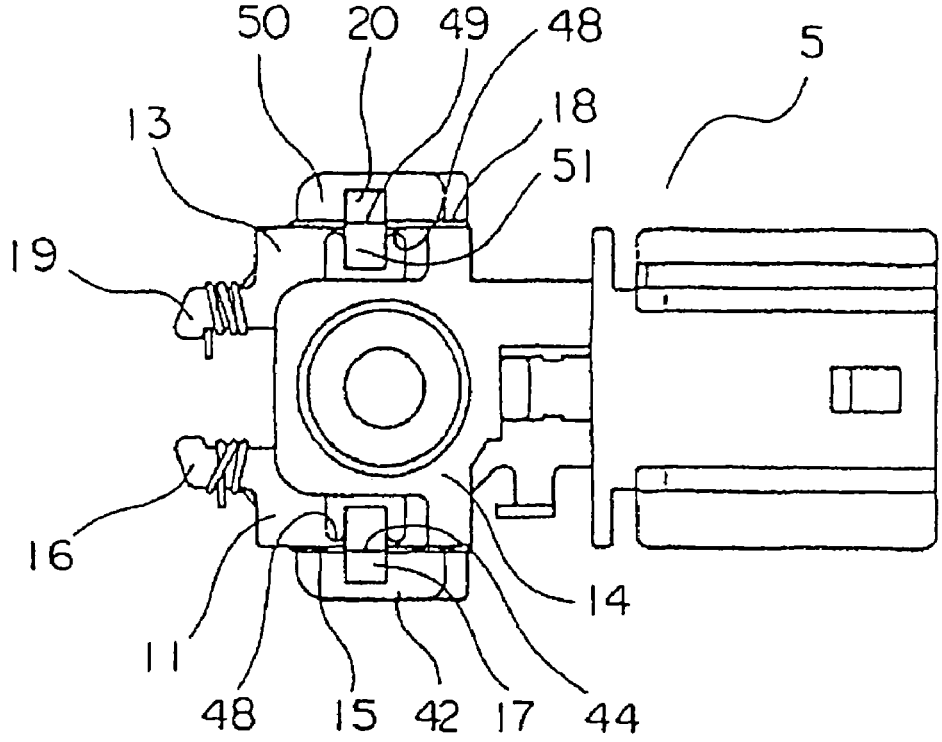
FIG. 4 is a front elevational view of a low-tension side connector shown in FIG. 1.
Figure 5:
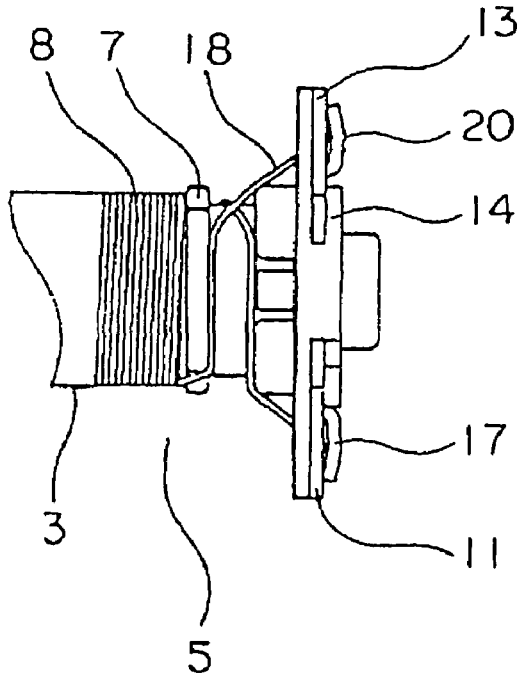
FIG. 5 is a left side view of FIG. 4.
Figure 6:
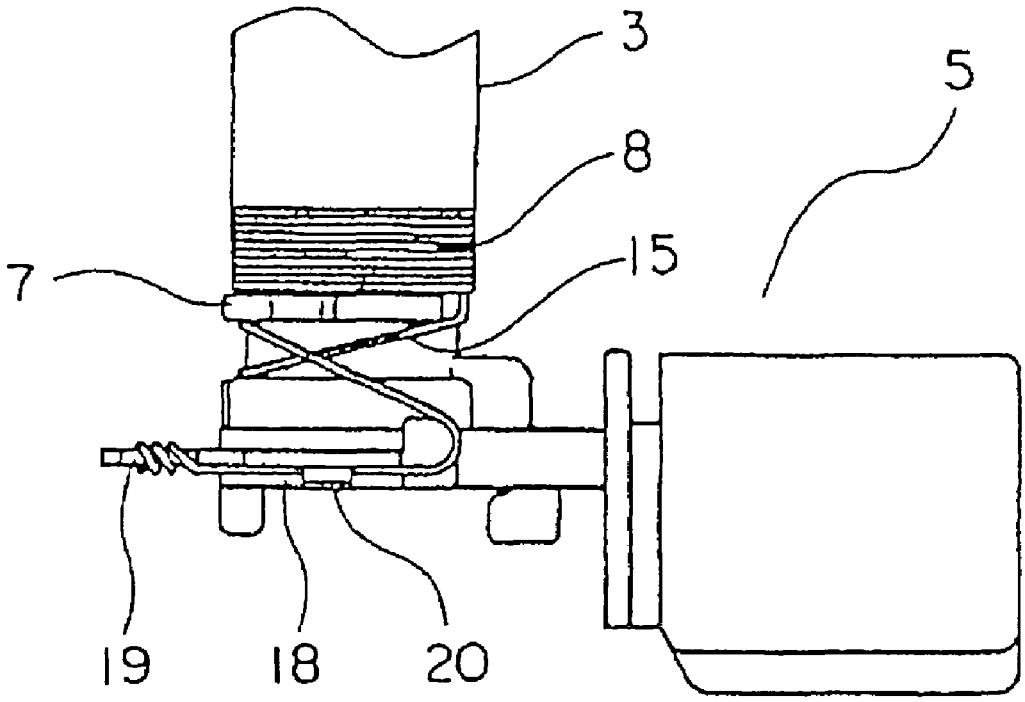
FIG. 6 is a plan view of FIG. 4.

FIG. 4 is a front elevational view of the low-tension side connector shown in FIG. 1. FIG. 5 is a left side view of FIG. 4, and FIG. 6 is a plan view of FIG. 4. Here, note that in FIG. 5, a state that a winding start conductor portion 15 is wound around a positive terminal side protruded portion 16 and a state that a winding end conductor portion 18 is wound around a negative terminal side protruded portion 19 are omitted.

The low-tension side connector 5 is provided with a positive side terminal 11 electrically connected to a battery (not shown), a negative side terminal 13 electrically connected to a control circuit 12 that has a power transistor for controlling the energization of the primary coil 3, and a low-tension side connector main body 14 that serves to integrate the positive side terminal 11 and the negative side terminal 13 with each other through a thermoplastic resin by means of insert molding.

The positive side terminal 11 is formed at its one end with a positive terminal side protruded portion 16 on which a part of the winding start conductor portion 15 of the primary winding 8, which is one end of the primary winding 8, is wound. An intermediate portion of the positive side terminal 11 has a positive terminal side fusing portion 17 that is formed by inverting a protrusion segment protruded in a direction perpendicular to the direction of extension of the winding start conductor portion 15 at an intermediate portion thereof, as shown in FIG. 7.

The negative side terminal 13 is formed at its one end with a negative terminal side protruded portion 19 on which a part of the winding end conductor portion 18 of the primary winding 8, which is the other end of the primary winding 8, is wound. An intermediate portion of the negative side terminal 13 has a negative terminal side fusing portion 20 that is formed by inverting a protrusion segment protruded in a direction perpendicular to the direction of extension of the winding end conductor portion 18 at an intermediate portion thereof.

After the winding start conductor portion 15 has been wound on the positive terminal side protruded portion 16, the conductor of the primary winding 8 is introduced into the primary bobbin 7 through the positive terminal side fusing portion 17, and is wound one turn around the primary bobbin 7, and continuously wound back therearound a further one turn to form the primary winding 8 of two turns. The winding end conductor portion 18 derived from the primary winding 8 is wound around the negative terminal side protruded portion 19 while passing through the negative terminal side fusing portion 20.

Figure 7:
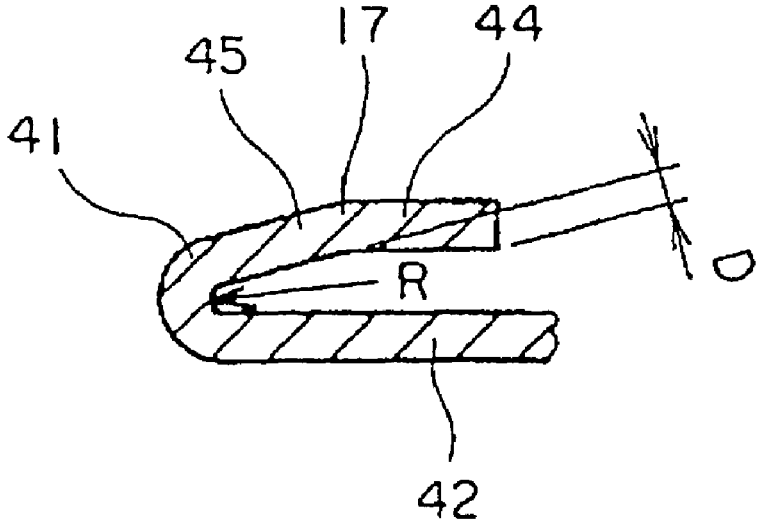
FIG. 7 is a cross sectional view showing a positive terminal side fusing portion of FIG. 4.

FIG. 7 is a cross sectional view of the positive terminal side fusing portion 17.

The positive terminal side fusing portion 17 is composed of a planar portion 42 and a turned portion 45 that is inversely bent or turned back from the planar portion 42 to cooperate therewith to clamp the winding start conductor portion 15. At a base end portion of this turned portion 45, there is formed a first bent portion 41 with a radius of curvature R. In an intermediate portion of the turned portion 45, there is also formed a second bent portion 44 with its tip end inclined or tilted toward the planar portion 42 of the positive side terminal 11.

Assuming that a minimum value for the wire diameter of the winding start conductor portion 15 is D1 min, the radius of curvature R of the first bent portion 41 is set equal to or less than (D1 min)/2.

Also, similar to the positive terminal side fusing portion 17, the negative terminal side fusing portion 20 is composed of a planar portion 50 and a turned portion 51 that is inversely bent or turned back from the planar portion 50 to cooperate therewith to clamp the winding end conductor portion 18. At a base end portion of this turned portion 51, there is formed a first bent portion with a radius of curvature R, and in an intermediate portion of the turned portion 51, there is also formed a second bent portion 49 with its tip end inclined or tilted toward the planar portion 50 of the negative side terminal 13.

Figure 8:
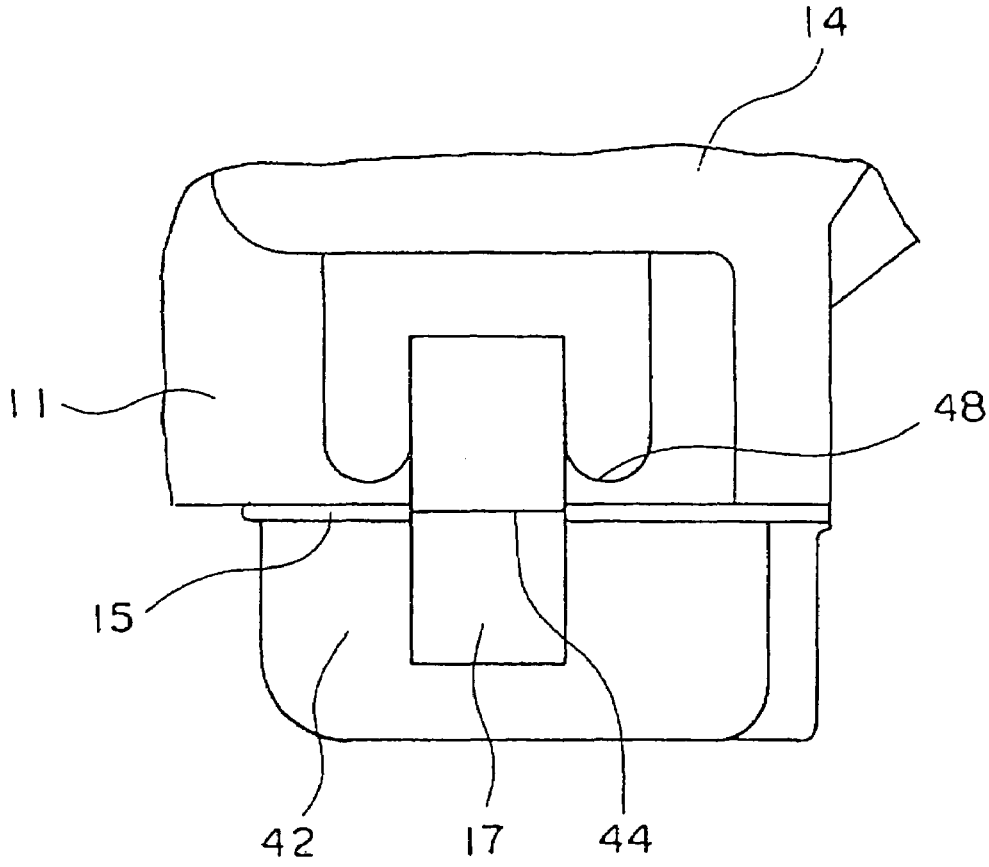
FIG. 8 is an enlarged view of essential portions of the low-tension side connector of FIG. 4.

FIG. 8 is an enlarged view of essential portions of the low-tension side connector 5 shown in FIG. 4, wherein the fusing portion 17 is formed by bending a protrusion segment that is created by notching or cutting away a part of the positive side terminal 11, and the second bent portion 44 of the positive side terminal 11 is formed at a location away from a notched portion 48 that is created when the protrusion segment is formed.

Although a notched portion 48 is similarly formed in the negative side terminal 13, too, the second bent portion 49 of the negative side terminal 13 is formed at a location away from the notched portion that is created upon formation of the protrusion segment.

The high-tension side connector 6 has a high-tension side connector main body 21 and a C-shaped resilient wire material 22 that is arranged on a peripheral wall surface of this high-tension side connector main body 21 at a spark plug side for applying a resilient force to the spark plug.

The winding start conductor portion 30 of the secondary winding 10 is connected with a winding start intermediate terminal 31, as shown in FIG. 3. This winding start intermediate terminal 31 is electrically connected with a welded fixed portion 32 (see FIG. 2) of the positive side terminal 11. The winding end conductor portion 33 of the secondary winding 10 is electrically connected with a winding end intermediate terminal 34. The winding end intermediate terminal 34 is electrically connected by a press fitting process with a tip end of the high-tension side connector 6 that is connected to the spark plug.

Figure 9:
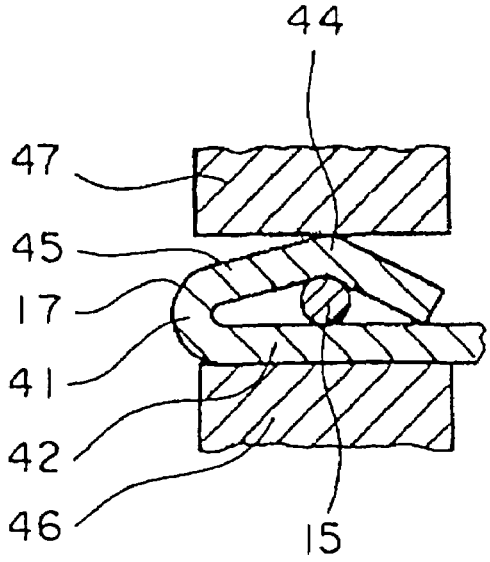
FIG. 9 is a cross sectional view showing a mode of use in which a winding start conductor portion in a fusing portion is subjected to fusing.

In the coil apparatus as constructed above, as shown in FIG. 9, the positive side terminal 11 is placed on the first fusing electrode 46, and the winding start conductor portion 15 is inserted between the planar portion 42 and the turned portion 45, after which the second fusing electrode 47 is caused to descend into pressure contact with the first fusing electrode 46. In this state, by supplying an electric current to the first and second fusing electrodes 46, 47, the enamel film of the winding start conductor portion 15 is burnt out, whereby the winding start conductor portion 15 and the positive terminal side fusing portion 17 are electrically connected with each other.

Here, note that the method of connection between the winding end conductor portion 18 and the negative terminal side fusing portion 20 is also identical with the method of connection between the winding start conductor portion 15 and the positive terminal side fusing portion 17.

According to the coil apparatus as constructed above, in the fusing portions 17, 20, the second bent portion 44 with its tip end inclined or tilted toward the planar portion 42 of the positive side terminal 11 is formed at the intermediate portion of the turned portion 45. With such an arrangement, as the second fusing electrode 47 is approaching the first fusing electrode 46, the winding start conductor portion 15 and the winding end conductor portion 18 are caused to slide toward the second bent portion 44 so that they are held fixed in their positions at the second bent portion 44.

Figure 10:
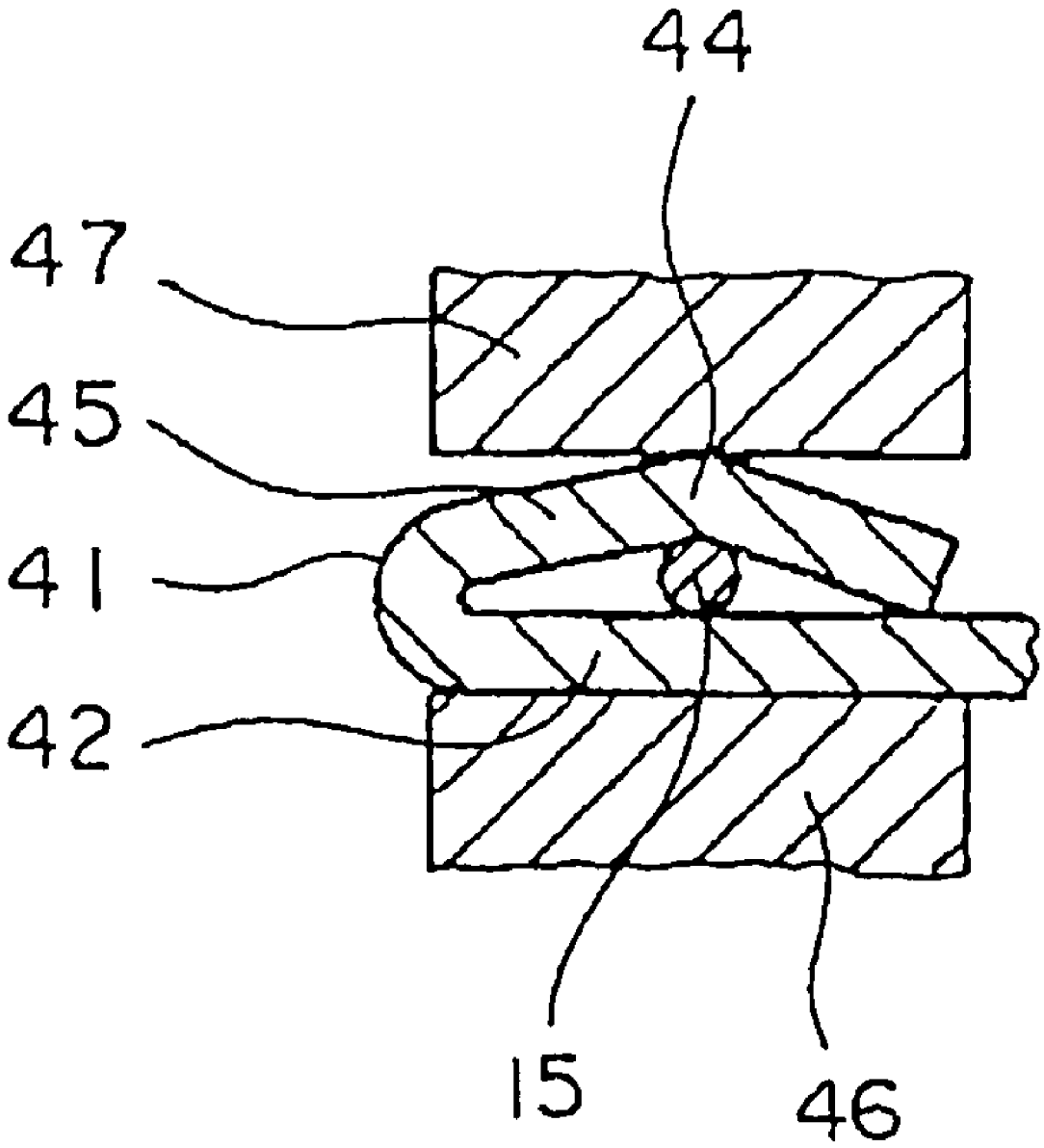
FIG. 10 is a cross sectional view showing another mode of use in which the winding start conductor portion in the fusing portion is subjected to fusing.

In addition, even in case where the winding start conductor portion 15 and the winding end conductor portion 18 are smaller than the wire diameter shown in FIG. 9, as the second fusing electrode 47 is approaching the first fusing electrode 46, the winding start conductor portion 15 and the winding end conductor portion 18 are caused to slide toward the second bent portion 44 so that they are held fixed in their positions at the second bent portion 44, as shown in FIG. 10.

Here, note that in order to permit the winding start conductor portion 15 and the winding end conductor portion 18 to slip toward the second bent portion 44, it is required that the radius of curvature R of the first bent portion 41 be equal to or less than the radius of the wire diameter of each of the winding start conductor portion 15 and the winding end conductor portion 18.

Thus, the winding start conductor portion 15 and the winding end conductor portion 18 are held fixed in their positions at the second bent portion 44, so that the electric current flowing between the electrodes 46, 47 flows through a predetermined path of the fusing portions 17, 20. As a result, the generation of heat becomes substantially constant, thus making it possible to improve the reliability of the fusing.

Moreover, since variation in the wire diameter of the primary winding is caused by an ignition system for the ignition coil, the wire diameter of the primary winding is generally larger in a CDI (Capacitor Discharge Ignition) system than in a full transistor ignition system which is a current interruption ignition system.

According to this embodiment, even with a change in the wire diameter due to an alteration between such ignition systems, it becomes possible to cope with such a situation without using specific terminals 11, 13 matched to the wire diameters of the winding start conductor portion 15 and the winding end conductor portion 18, thus making it possible to reduce the manufacturing cost.

Further, in case where the amount of deformation D (see FIG. 7), with which the second bent portion 44 is inclined or tilted toward the planar portion 42, is larger than the wire diameter of each of the winding start conductor portion 15 and the winding end conductor portion 18, when the second fusing electrode 47 is caused to descend to be placed into pressure contact with the second fusing electrode 47, the tip end of the turned portion 45 abuts against the planar portion 42, so electric current at the time of fusing flows through this tip end, too. Accordingly, the electric current flowing between the electrodes 46, 47 flows simultaneously through three routes including a first path that passes through the tip end of the bent portion 45, a second path that passes through the winding start conductor portion 15 and the winding end conductor portion 18, and a third path that passes through the first bent portion 41. As a result, the precision of the fusing current can be improved, thereby making it possible to improve the reliability of the fusing.

Also, in case where the amount of deformation D, with which the second bent portions 44, 49 are inclined or tilted toward the planar portions 42, 50, respectively, is equal to the wire diameter of each of the winding start conductor portion 15 and the winding end conductor portion 18, three routes are formed for the electric current flowing between the electrodes 46, 47.

Furthermore, the second bent portion 44 of the positive side terminal 11 and the second bent portion 49 of the negative side terminal 13 are formed at locations away from the corresponding notched portions 48 that are created when the corresponding protrusion segments are formed, so the winding start conductor portion 15 positioned by the second bent portion 44 and the winding end conductor portion 18 positioned by the second bent portion 49 pass through locations away from the corresponding notched portions 48, respectively.

Accordingly, there can be avoided an inconvenience that might occur when the winding start conductor portion 15 and the winding end conductor portion 18 are arranged to pass on the notched portions 48, i.e., an inconvenience in which the heat cycle of the primary coil 3 is repeated to cause cyclic tensile and compressive stress concentrations in the winding start conductor portion 15 and the winding end conductor portion 18 on the edges of the notched portions 48, thus resulting in a break or open circuit.

In the above embodiment, both the winding start conductor portion 15 and the winding end conductor portion 18 are electrically connected by a fusing method with the fusing portions 17, 20, respectively, which are of the same structure, but only either one of them may be electrically connected with a corresponding conductor portion by using a fusing portion of the above construction.

In addition, although in the above embodiment, reference has been made to the independent cylinder type ignition coil apparatus in which the primary coil 3 and the secondary coil 4 are arranged in a plug hole in the internal combustion engine, the present invention is of course not limited to this, but can also be applied to a variety of types of ignition coil apparatuses for an internal combustion engine, such as, for example, simultaneous ignition/independent ignition, cylindrical type/non-cylindrical type, etc.

While the invention has been described in terms of a preferred embodiment, those skilled in the art will recognize that the invention can be practiced with modifications within the spirit and scope of the appended claims.

What is claimed is:

1. An ignition coil apparatus for an internal combustion engine comprising:

a case;

a center core arranged in said case;

a primary coil and a secondary coil arranged outside of said central core; and a low-tension side connector with a terminal having a fusing portion electrically connected through fusing with an end of a primary winding of said primary coil;

wherein said fusing portion comprises a planar portion and a turned portion that is inversely bent back from said planar portion to cooperate therewith to clamp said end of said primary winding;

a first bent portion of a radius of curvature R is formed at a base end portion of said turned portion; and a second bent portion with its tip end tilted to said planar portion is formed at an intermediate portion of said turned portion.

2. The ignition coil apparatus for an internal combustion engine as set forth in claim 1, wherein said radius of curvature R of said first bent portion is equal to or less than a radius of a wire diameter of said end of said primary winding.

3. The ignition coil apparatus for an internal combustion engine as set forth in claim 1, wherein an amount of deformation with which said second bent portion is titled toward said planar portion is equal to or more than a wire diameter of said end of said primary winding.

4. The ignition coil apparatus for an internal combustion engine as set forth in claim 1, wherein said fusing portion is formed by bending a protrusion segment that is created by notching said terminal, and said second bent portion of said terminal is formed at a location away from a notched portion that is created upon formation of said protrusion segment.

5. The ignition coil apparatus for an internal combustion engine as set forth in claim 1, wherein said end of said primary winding is at least one of opposite ends of said primary winding.

* * * * *